US010386140B2

(12) United States Patent
Kramer

(10) Patent No.: US 10,386,140 B2
(45) Date of Patent: Aug. 20, 2019

(54) DIRECT GAS IMPINGEMENT SYSTEM

(71) Applicant: Kramer Cartridge & Carbine LLC, Las Vegas, NV (US)

(72) Inventor: Lawrence S. Kramer, Las Vegas, NV (US)

(73) Assignee: KRAMER CARTRIDGE & CARBINE LLC, Las Vegas, NV (US)

( * ) Notice: Subject to any disclaimer, the term of this patent is extended or adjusted under 35 U.S.C. 154(b) by 0 days.

(21) Appl. No.: 16/005,381

(22) Filed: Jun. 11, 2018

(65) Prior Publication Data

US 2018/0372435 A1 Dec. 27, 2018

Related U.S. Application Data

(60) Provisional application No. 62/518,166, filed on Jun. 12, 2017.

(51) Int. Cl.

| | |
|---|---|
| ***F41A 5/26*** | (2006.01) |
| ***F41A 3/66*** | (2006.01) |
| ***F41A 3/12*** | (2006.01) |

(52) U.S. Cl.

CPC *F41A 5/26* (2013.01); *F41A 3/12* (2013.01); *F41A 3/66* (2013.01)

(58) Field of Classification Search

CPC ..... F41A 5/26; F41A 3/12; F41A 3/66

USPC ..... 89/193

See application file for complete search history.

(56) References Cited

U.S. PATENT DOCUMENTS

| | | | | | |
|---|---|---|---|---|---|
| 3,592,101 | A * | 7/1971 | Vartanian | F41A 5/26 | 89/193 |
| 4,244,273 | A * | 1/1981 | Langendorfer, Jr. | F41A 5/28 | 89/193 |
| 4,246,830 | A * | 1/1981 | Krieger | F41A 19/13 | 89/132 |
| 4,765,224 | A * | 8/1988 | Morris | F41A 5/26 | 42/75.02 |
| 5,272,956 | A * | 12/1993 | Hudson | F41A 5/28 | 42/72 |
| 5,351,598 | A * | 10/1994 | Schuetz | F41A 5/18 | 42/25 |
| 5,726,377 | A * | 3/1998 | Harris | F41A 19/14 | 42/65 |
| 5,824,943 | A * | 10/1998 | Guhring | F41A 5/26 | 89/192 |
| 5,911,173 | A * | 6/1999 | Westrom | F41A 15/12 | 89/185 |

(Continued)

*Primary Examiner* — Michelle Clement

(74) *Attorney, Agent, or Firm* — Patterson + Sheridan, LLP

(57) ABSTRACT

Implementations described herein generally relate to gas operating systems including direct gas impingement systems for a weapon system, such as the AR15, M16, and M4 weapon systems. The gas operating system includes a gas channel carrier rail and a bolt carrier group. The gas channel carrier rail contains a main gas channel disposed between an inlet end an outlet end, where the outlet end is flared to have a larger diameter than the inlet end. A slot is formed in the outlet end and extends along the main gas channel. The bolt carrier group contains a carrier assembly, a bolt assembly, and a gas channel carrier guide, where the bolt assembly is at least partially contained within the carrier assembly. The gas channel carrier guide is disposed on the carrier assembly, extends through the slot, and is at least partially disposed into the gas channel carrier rail.

26 Claims, 6 Drawing Sheets

(56) References Cited

U.S. PATENT DOCUMENTS 7,275,472 B1 * 10/2007 Finn ..... F41A 3/74 89/26
8,893,608 B2 * 11/2014 Kramer ..... F41A 5/26 89/193
9,435,593 B2 * 9/2016 McGinty ..... F41A 35/06
9,863,729 B2 * 1/2018 Blank ..... F41A 3/26
10,151,544 B1 * 12/2018 Sugg ..... F41A 5/26
2002/0073832 A1 * 6/2002 Vignaroli ..... F41A 5/18 89/191.01
2010/0186582 A1 * 7/2010 Juarez ..... F41A 5/28 89/191.01
2012/0180648 A1 * 7/2012 Sullivan ..... F16J 9/16 89/193
2013/0269510 A1 * 10/2013 Sullivan ..... F41A 5/28 89/193
2013/0284008 A1 * 10/2013 Pizano ..... F41A 5/26 89/193
2014/0060294 A1 * 3/2014 Brown ..... F41A 5/24 89/1.4
2014/0076144 A1 * 3/2014 Gomez ..... F41A 3/38 89/132
2014/0076151 A1 * 3/2014 Kramer ..... F41A 5/26 89/193
2014/0144314 A1 * 5/2014 Jensen ..... F41A 3/64 89/193
2014/0318361 A1 * 10/2014 Larue ..... F41A 5/24 89/193
2015/0184960 A1 * 7/2015 Monveldt ..... F41A 5/26 89/193
2015/0226502 A1 * 8/2015 Beaty ..... F41A 5/28 89/193
2015/0241149 A1 * 8/2015 McMillen, IV ..... F41A 5/28 89/193
2015/0260467 A1 * 9/2015 Blank ..... F41A 3/30 42/25
2016/0047612 A1 * 2/2016 Sullivan ..... F16J 9/16 89/191.01
2016/0076834 A1 * 3/2016 McGinty ..... F41A 35/06 89/194
2016/0178308 A1 * 6/2016 Daniel ..... F41A 35/00 89/193
2017/0153075 A1 * 6/2017 DeSomma ..... F41A 3/66
2017/0234634 A1 * 8/2017 Hirt ..... F41A 5/18 89/193
2018/0172373 A1 * 6/2018 Maranli ..... F41A 3/26

* cited by examiner

DIRECT GAS IMPINGEMENT SYSTEM

BACKGROUND

Field

Implementations described herein generally relate to gas operating systems for weapon systems, and more specifically to a direct gas impingement system used on semi-automatic and/or full-automatic weapon systems, such as the AR15, M16, and M4 weapon systems.

Description of the Related Art

The AR15, M16, and M4 weapon systems were originally designed to operate with a traditional direct gas impingement (DGI) system. The DGI system uses gases generated from the fired cartridge to operate the weapons action. Gases from the fired cartridge are tapped from a gas port in the barrel and directed back through a "gas tube" into the bolt carrier key and bolt carrier, pressurizing a small chamber between the rear of the bolt and the bolt carrier. Expanding gases drive the bolt carrier to the rear, unlocking the bolt from a barrel extension allowing the bolt and carrier to move to the rear and cycle the action of the weapon.

For the weapon to operate correctly and reliably, the action components of the AR15, M16, and M4 weapon systems should be kept well lubricated, specifically the bolt and bolt carrier components, to avoid malfunctions. Due to the way traditional DGI systems operate, a DGI system delivers heat and carbon from each fired cartridge back into the action of the weapon, most notability the bolt and bolt carrier and the inside of the upper receiver. The heat builds up quickly when the rifle is quickly fired fast in full-automatic mode or semi-automatic mode. The heat and carbon dries out the lubrication used on the action to keep the action operating, which requires adding more lubrication to maintain the weapons reliability. This process leads to the action of the weapon becoming "gummed up" or stuck and can lead to malfunctions. This repeated adding of lubrication to keep the weapon operational also attracts dust and dirt from desert type environments which can also lead to more frequent malfunctions. The rapid heat buildup from this design also has a negative impact on the weapons parts, contributing to early parts failure.

The traditional DGI system used in the AR15, M16, and M4 weapon systems was effective but very inefficient, and is a "leaky" and wasteful design, requiring much more of the propellant gasses to operate the weapon than what are actually needed. The traditional DGI system's "open design" contributes to its overheating and fouling of the weapons action. The area of the system where this is most apparent is the rear of the gas tube and the carrier key located on top of the bolt carrier. The carrier key slides over the rear of the gas tube and rests there until the weapon is fired. When the weapon is fired the carrier moves to the rear as the system is pressurized. As the bolt carrier moves to the rear the carrier key retracts from the gas tube and the carrier continues moving rearward approximately three inches to cycle the action. Pressurized gases from the fired cartridge continue to flow out of the gas tube even after the carrier key has separated from the rear of the gas tube, depositing hot dirty carbon laden gasses into the upper receiver of the weapon until the bolt carrier is again moved forward by the operating spring and the carrier key covers the exposed rear of the gas tube and the action closes. Pressurized gases from the fired cartridge continue to flow out the rear of the gas tube the entire time it is not covered by the carrier key.

The gas chamber of the traditional DGI system is made up of the rear of the bolt and back inside of the bolt carrier. The front of this chamber that is the rear of the bolt has three gas rings on a journal that forms a tight seal and contains the gases, the rear of the gas chamber formed by the bolt carrier has an open channel that the back or tail of the bolt sits in, there is a large gap in this location between the tail of the bolt and the bolt carrier channel, it is not sealed with gas rings like the front of the chamber. This open space allows the pressurized gases to flow freely out the back of the bolt carrier. This "loose fit open design" allows propellant gases to escape out of the rear of the carrier depositing hot, dirty propellant gasses into the upper receiver, contributing to fouling of the action and weapon malfunctions.

These negative effects of the traditional DGI system have led to development of many different designs of gas piston systems for the AR15, M16, and M4 weapon systems. Most of these gas piston systems work in basically the same way, in that they use the tapped gas from a gas port in the barrel to pressurize the system in the same manner the traditional DGI system does. The pressurized gas goes into a small chamber at or near the gas port on the barrel near the front of the weapon, the gas then pressurizes a piston that actuates an operating rod or push rod that pushes the bolt carrier to the rear of the weapon unlocking the bolt and cycling the weapon. Gas piston systems keep the hot and dirty propellant gasses from the fired cartridge at the gas block located out on the barrel and away from the action and operating parts of the weapon. This keeps the weapon cleaner and cooler which increases reliability, reduces maintenance, and reduces heat induced fatigue of parts.

Drawbacks associated with gas piston systems include increased weight and cost, and in some cases reduced accuracy due to the parts connected to the barrel. An additional drawback of a gas piston actuated weapon system is the "carrier tilt" induced by the system. The operating rod of the gas piston system "pushes" on the front of the carrier key or push pad" mounted on top of the front of the bolt carrier. When the bolt carrier is pushed from this location, it induces a "tilting" or "rotating" force, pushing the rear of the carrier down and knocking it out of alignment with the receiver extension and jamming the weapon. To resolve this issue the rear of the carrier is machined with a "beveled" bottom so that it deflects back up into alignment with the receiver extension and will then move rearward back into the receiver extension to allow for normal cycling of the weapon. This solution does allow the weapon to cycle using a gas piston design, but this momentary "tilt" out of alignment happens when the bolt is unlocking from the barrel extension and causes uneven wear on the back of the bolt lugs where they contact the lugs on the barrel extension, leading to uneven wear and potential earlier lug failure. The traditional DGI system does not have this "carrier tilt" issue because it operates with a "pressurized in-line" balanced style system, but still suffers from the drawbacks discussed above.

Therefore, there is a need for an improved gas operating system that is more efficient, cleaner discharging, and having more consistent cycling than traditional direct gas impingement system used in weapon systems.

SUMMARY

Implementations described herein generally relate to gas operating systems for weapon systems, and more specifically to a direct gas impingement system used on semi-automatic and/or full-automatic weapon systems, such as the AR15, M16, and M4 weapon systems. In one or more embodiments, the gas operating system includes a gas channel carrier rail and a bolt carrier group. The gas channel carrier rail contains a main gas channel disposed between an inlet end an outlet end, where the outlet end is flared to have a larger diameter than the inlet end. A slot is formed in the outlet end and extends along the main gas channel. The bolt carrier group contains a carrier assembly, a bolt assembly, and a gas channel carrier guide, where the bolt assembly is at least partially contained within the carrier assembly. The gas channel carrier guide is disposed on the carrier assembly, extends through the slot, and is at least partially disposed into the gas channel carrier rail.

In other embodiments, the gas operating system includes a gas channel carrier rail, a bolt carrier group, and a gas chamber disposed in the bolt carrier group. The gas channel carrier rail contains a main gas channel disposed between an inlet end an outlet end, where the outlet end includes a slot extending along the main gas channel. The bolt carrier group contains a carrier assembly, a bolt assembly, and a gas channel carrier guide, where the bolt assembly is at least partially contained within the carrier assembly. The gas channel carrier guide is disposed on the carrier assembly, extends through the slot, and is at least partially disposed into the gas channel carrier rail, and wherein the gas channel carrier guide comprises a secondary gas channel extending therethrough. The gas chamber is in fluid communication with the main gas channel via the secondary gas channel and is formed between the carrier assembly, the bolt assembly, and two gas seals.

In some embodiments, an upper receiver assembly for a weapon system can include an upper receiver comprising a barrel, a gas block fluidly coupled to the barrel, and a gas operating system fluidly coupled to the gas block, where the gas operating system is described and discussed herein.

BRIEF DESCRIPTION OF THE DRAWINGS

So that the manner in which the above recited features of the disclosure can be understood in detail, a more particular description of the disclosure, briefly summarized above, may be had by reference to implementations, some of which are illustrated in the appended drawings. It is to be noted, however, that the appended drawings illustrate only typical implementations of this disclosure and are therefore not to be considered limiting of scope, for the disclosure may admit to other equally effective implementations.

Figure 1:
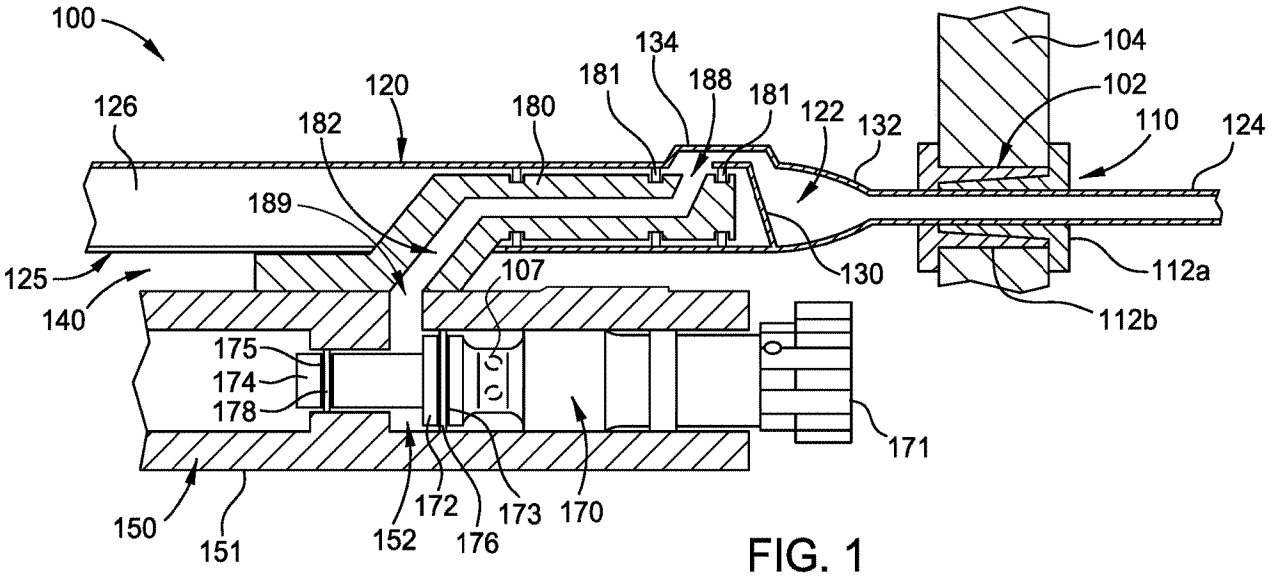
FIG. 1 depicts a partial schematic, cross-sectional view of a gas operating system for a weapon system, according to one or more embodiments described herein.

To facilitate understanding, identical reference numerals have been used, where possible, to designate identical elements that are common to the Figures. It is contemplated that elements and features of one implementation may be beneficially incorporated in other implementations without further recitation.

DETAILED DESCRIPTION

Figure 2:
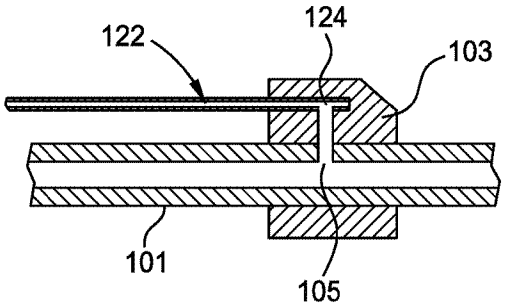
FIG. 2 depicts a schematic, cross-sectional view of another portion of the gas operating system shown in FIG. 1, according to one or more embodiments described herein.

Implementations described herein generally relate to gas operating systems for weapon systems, and more specifically to a direct gas impingement system used on automatic and/or semi-automatic weapon systems, such as the AR15, M16, and M4 weapon systems. FIG. 1 depicts a partial schematic, cross-sectional view of a gas operating system 100 for a firearm or other weapon system, according to one or more embodiments described herein. The gas operating system 100 is a direct gas impingement system and includes a gas channel carrier rail 120 and a bolt carrier group 140. The gas channel carrier rail 120 contains a main gas channel 122 disposed between an inlet end 124 an outlet end 126. The outlet end 126 is flared or otherwise expanded to have a segment 132 that has a larger diameter than the inlet end 124. The outlet end 126 of the gas channel carrier rail 120 can also include an extended portion 134 on the upper surface of the gas channel carrier rail 120. The gas channel carrier rail 120, including the inlet end 124, the outlet end 126, the segment 132, and the extended portion 134 can be a monolithic piece, as depicted in FIGS. 1 and 2. The gas channel carrier rail 120 can be made of or contain one or more metals, such as steel, stainless steel, titanium, or alloys thereof.

The gas channel carrier rail 120 extends through an adjustable tensioner 110 that is attached to and passes through an opening 102 passing through a wall of the upper receiver 104 of the firearm, as depicted in FIG. 1. The adjustable tensioner 110 supports and provides passage of the gas channel carrier rail 120 through the opening 102 of the upper receiver 104. The adjustable tensioner 110 stabilizes the gas channel carrier rail 120 to ensure precise alignment within the upper receiver during cycling of the weapon. The adjustable tensioner 110 can be tensioned or tightened around the gas channel carrier rail 120, allowing for a more rigid configuration to increase the accuracy of the weapon. The adjustable tensioner 110 can be or include a collet, a grommet, a chuck, a tensioning collar, or other type of device for supporting and providing passage of the gas channel carrier rail 120 through the opening 102.

In one or more embodiments, the adjustable tensioner 110 is a two-piece member which includes interlocking components 112*a*, 112*b*, which are installed from opposite sides of the wall of the upper receiver 104 so to engage one another. In such an embodiment, each of the two pieces include tapered surfaces which engage one another to form an interference fit. Each of the two pieces include a base portion for contacting outer (and opposite) surfaces of the upper receiver front wall. In one example, each of the two components 112*a* and 112*b* of the adjustable tensioner 110 are positioned concentrically with respect to one another. In some examples, the adjustable tensioner 110 is a grommet having two or more segments or portions, such as components 112*a* and 112*b*. As shown in FIG. 1, the component 112*b* of a grommet is screwed or otherwise coupled to the opening 102 of the upper receiver 104 and the component 112*a* of the grommet is disposed into the component 112*b*.

The inlet end 124 of the gas channel carrier rail 120 is configured to couple to a gas block 103 disposed on a barrel 101 of the weapon system, as depicted in FIG. 2. A passageway 105 is disposed between and in fluid communication of the barrel 101 and the main gas channel 122 at the inlet end 124. In one or more embodiments, the inlet end 124 of the gas channel carrier rail 120 includes a gas tube portion between the gas block 103 and the adjustable tensioner 110 that is straight or significantly straight and parallel or significant parallel to the barrel 101. In other embodiments, the inlet end 124 of the gas channel carrier rail 120 includes a gas tube portion between the gas block 103 and the adjustable tensioner 110 that has one or more bends or curves.

The gas block 103 can be any gas block that meets or exceeds U.S. military specifications for the M16 or M4 weapon systems or any gas block used in the AR15 weapon system. The gas block 103 attached to the barrel 101 that directs the expanding gases from the gas port 105 in the barrel 101 into the inlet end 124 of the gas channel carrier rail 120. The gas channel carrier rail 120 may attach to the gas block 103 with a pin or screw. The gas block 103 may be any height or profile (e.g., low or high profile gas blocks) to accommodate the gas channel carrier rail 120 with straight line profile or a bent or curved profile.

The gas channel carrier rail 120 also contains a slot 125 (depicted in FIG. 4B and further discussed below) formed in the outlet end 126. The slot 125 extends along the gas channel carrier rail 120 in the same direction as the main gas channel 122. The gas channel carrier guide 180 extends through the slot 125 and is at least partially disposed into the gas channel carrier rail 120, as shown in FIG. 1.

The bolt carrier group 140 contains a carrier assembly 150, a bolt assembly 170, and a gas channel carrier guide 180. The bolt assembly 170 is at least partially contained within the carrier assembly 150. The bolt assembly 170 and the carrier assembly 150 are axial to one another. A bolt head 171 of the bolt assembly 170 extends from the carrier assembly 150.

The gas channel carrier guide 180 is disposed on a carrier body 151 of the carrier assembly 150. In one or more embodiments, the gas channel carrier guide 180 and the carrier body 151 are monolithic, as such, are formed or otherwise produced as a single unit having a one piece design. In other embodiments, the gas channel carrier guide 180 and the carrier body 151 are separate parts that are fastened or combined together. For example, one, two, three, or more fasteners can be used to couple the gas channel carrier guide 180 and the carrier body 151 together. In one example, the gas channel carrier guide 180 and the carrier body 151 are coupled together with two bolts that pass through the gas channel carrier guide 180 and into threaded holes in the carrier body 151 and are each staked at the gas channel carrier guide 180. In other examples, the gas channel carrier guide 180 and the carrier body 151 are welded together. Each of the gas channel carrier guide 180 and the carrier body 151 can be made of or contain one or more metals, such as steel, stainless steel, titanium, or alloys thereof.

The gas channel carrier guide 180 contains a secondary gas channel 182 passing therethrough. The secondary gas channel 182 is disposed between and in fluid communication with the main gas channel 122 and an interior (e.g., gas chamber 152) of the bolt carrier group 140. The gas channel carrier guide 180 contains a lower segment 184 and an upper segment 186. The lower segment 184 is coupled to the carrier assembly 150. The upper segment 186 extends through the slot 125 and is at least partially disposed into the gas channel carrier rail 120. The gas channel carrier guide 180 contains an inlet port 188 and an outlet port 189. The inlet port 188 is in fluid communication with and coupled to the main gas channel 122 and the outlet port 189 is in fluid communication with and coupled to the carrier body 151 of the bolt carrier group 140. The secondary gas channel 182 extends from the inlet port 188 to the outlet port 189 and to the interior of the bolt carrier group 140, such as into the gas chamber 152. In one or more embodiments, the gas channel carrier guide 180 can include a gas tube or guide that is hollow or has a passageway in the center with the secondary gas channel 182 that passes from the top center at the inlet port 188, through the neck of the guide, out of the bottom at the outlet port 189, and into the carrier body 151 and into the gas chamber 152.

Figure 4A:
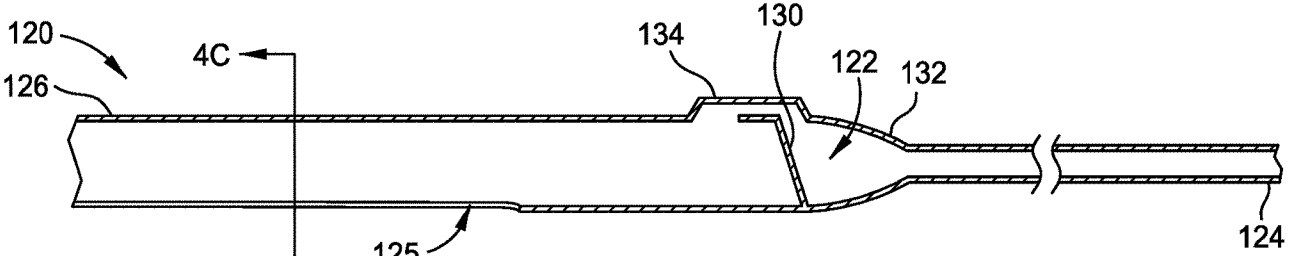
FIGS. 4A-4C depict schematic views of a gas channel carrier rail, according to one or more embodiments described herein.

The outlet end 126 of the gas channel carrier rail 120 contains one or more baffles 130 within the main gas channel 122, as depicted in FIGS. 1 and 4A. The baffles 130 can be within the flared or expanded segment 132 and/or the extended portion 134 of the outlet end 126. The baffle 130 and the flared or expanded segment 132 and/or the extended portion 134 helps direct gas flow of the propellant gas from the main gas channel 122 to the inlet port 188.

Figure 3B:
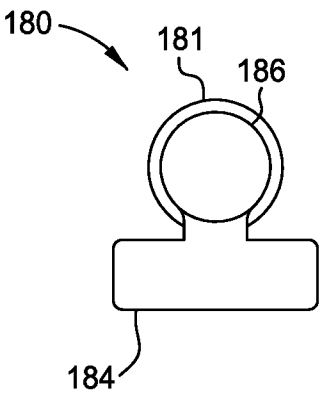
FIGS. 3A and 3B depict schematic views of a gas channel carrier guide, according to one or more embodiments described herein.
Figure 3A:
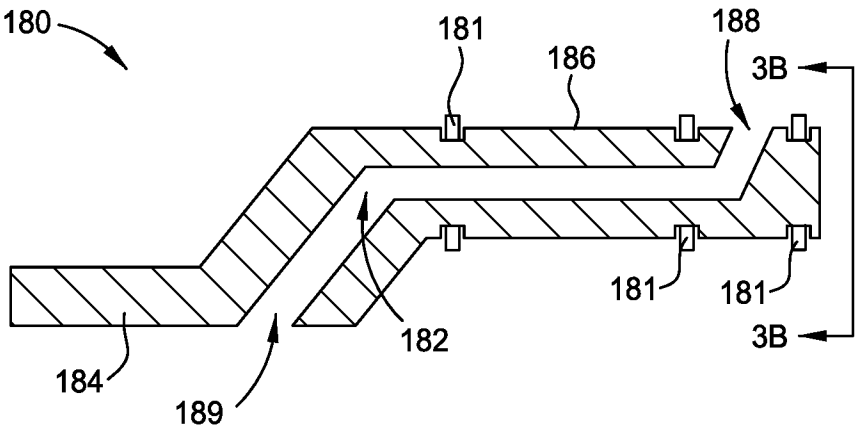

FIGS. 3A and 3B depict schematic views of the gas channel carrier guide 180, according to one or more embodiments described herein. FIG. 3A depicts a cross-sectional view and FIG. 3B depicts a front view of the gas channel carrier guide 180. The gas channel carrier guide 180 contains two, three, or more gas seals 181 disposed on an outer surface of the gas channel carrier guide 180. The gas seals 181 can be disposed in a groove or recess formed in the outer surface of the gas channel carrier guide 180, as shown in FIGS. 1 and 3A. The gas seals 181 are disposed between and in contact with the gas channel carrier guide 180 and the gas channel carrier rail 120. The gas channel carrier guide 180 contains the inlet port 188 in fluid communication with the main gas channel 122. The inlet port 188 is disposed between the two gas seals 181. The inlet port 188 is disposed on an upper surface of the gas channel carrier guide 180. In one or more embodiments, the gas channel carrier guide 180 provides a "sealed" channel that initially prevents the pressurized propellant gas from the fired cartridge from exiting the gas operating system 100. The gas channel carrier guide 180 and two gas seals 181 separated by the inlet port 188 form a fluid tight seal that directs exhausted propellant gas into the secondary gas channel 182.

The gas chamber 152 is formed or otherwise disposed within the interior of the bolt carrier group 140. The gas chamber 152 is in fluid communication with the main gas channel 122 via the secondary gas channel 182 disposed in the gas channel carrier guide 180. The gas chamber 152 is formed between the carrier assembly 150, the bolt assembly 170, and two or more gas seals 176, 178 therebetween. The two gas seals 176, 178 can include a first gas seal 176 and a second gas seal 178. The first gas seal 176 is contained on a journal or gas collar 172 disposed on the bolt assembly 170. The gas collar 172 can include one or more recesses or grooves 173 for containing one or more gas seals 176. The bolt assembly 170 has a bolt tail 174 that can include one or more recesses or grooves 175 for containing one or more gas seals 178. Alternatively, the boat tail 174 on the bolt assembly 170 does not have a recess or groove and therefore the second gas seal 178 can be contained directly on the surface of the bolt tail 174. Each of the gas seals 176, 178 can independently be or include 1, 2, 3, 4, or more rings, seals, gaskets, O-rings, or other devices used for gas sealing between two or more surfaces. In some examples, each of the gas seals 176, 178 can independently be metallic gas rings that meet or exceed U.S. military specifications for the M16 or M4 weapon systems. In one or more examples, the first gas seal 176 contains three metallic gas rings and the second gas seal 178 contains three metallic gas rings. In one or more embodiments, the bolt assembly 170 can be a bolt assembly that meets or exceeds U.S. military specifications for the M16 or M4 weapon systems, but has been modified by adding the second gas seal 178 on the bolt tail 174 and/or optionally modifying forming the recess or groove 175 on the bolt tail 174.

Figure 5:
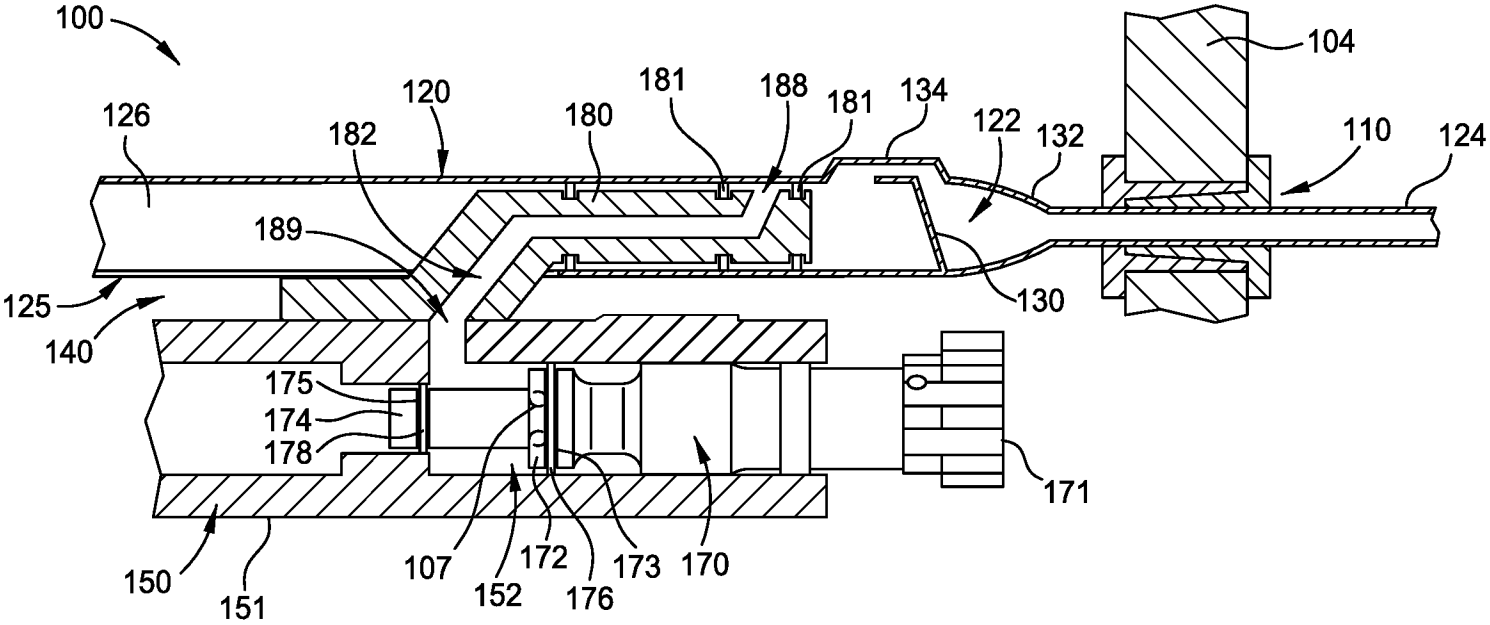
FIG. 5 depicts a schematic, cross-sectional view of the gas operating system shown in FIG. 1, where the system is pressurized with propellant gas and the bolt carrier group has started to move towards the rear of the weapon, according to one or more embodiments described herein.

In FIG. 1, the bolt assembly 170 is in a contracted or non-extended position relative to the carrier assembly 150. The bolt assembly 170 is all the way forward and the bolt head 171 is closed and locked into the barrel extension. The secondary gas channel 182 in the gas channel carrier guide 180 is aligned with the inlet port 188 in the gas channel carrier rail 120. In FIG. 5, the bolt assembly 170 is in an extended position relative to the carrier assembly 150. One, two, three, or more exhaust ports 107 (two exhaust ports are drawn in phantom in FIGS. 1 and 5) extend through the carrier body 151 to fluidly connect the gas chamber 152 to outside of the bolt carrier group 140 once the bolt assembly 170 is in the extended position (e.g., during cycling of the firearm) relative to the carrier assembly 150. The exhaust ports 107 are further described and discussed below. In other embodiments, the carrier body 151 can be a carrier body that meets or exceeds U.S. military specifications for the M16 or M4 weapon systems, but has been modified by increasing the diameter of the inner volume to provide clearance for the second gas seal 178 on the bolt tail 174 when the bolt assembly 170 is contained therein.

Although not shown in the Figures or described in the written description, the bolt carrier group 140 includes all other parts and components contained in a bolt carrier group that meets or exceeds U.S. military specifications for the M16 or M4 weapon systems. For example, exemplary parts or components used on or in the bolt carrier group 140 can be or include, but is not limited to, a firing pin, a firing pin retaining pin, a cam pin, an extractor, an ejector, all pins and springs used with the extractor and the ejector, and/or any combination thereof. In one or more embodiments, each of the gas channel carrier rail 120, the gas channel carrier guide 180, the carrier body 151, the bolt assembly 170, or any parts or portions thereof can independently have a coating or no coating. The coating can be or include an anodizing coating, a parkerized coating, a phosphate coating (e.g., manganese phosphate), a nitride coating, a boride coating, a nickel coating (e.g., nickel boride or nickel nitride), a chromium coating, alloys thereof, or any combination thereof.

Figure 4B:
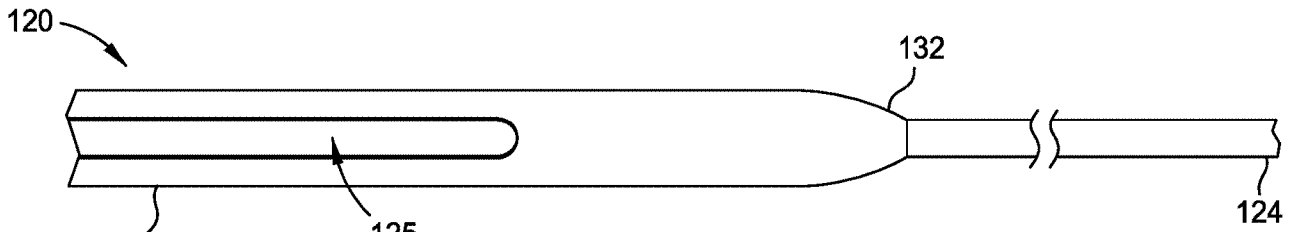
Figure 4C:
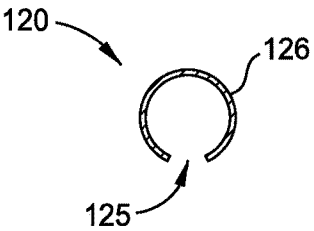

FIGS. 4A-4C depict schematic views of the gas channel carrier rail 120, according to one or more embodiments described herein. FIG. 4A depicts a cross-section view and FIG. 4B depicts a bottom view of the gas channel carrier rail 120. FIG. 4C is cross-sectional view of the outlet end 126 of the gas channel carrier rail 120. The inlet end 124 of the gas channel carrier rail 120 directs propellant gas from the gas block 103 back into the action of the weapon. After the propellant gas passes into the upper receiver 104, the rear portion or the outlet end 126 of the gas channel carrier rail 120 increases in diameter to a size which accommodates the gas channel carrier guide 180 therein. With the gas channel carrier guide 180 positioned in the gas channel carrier rail 120, the gas channel carrier rail 120 functions as a "guide" or track for the gas channel carrier guide 180 as the gas channel carrier guide 180 moves back and forth during operation within the gas channel carrier rail 120. Additionally, the gas channel carrier rail 120 also provides the main gas channel 122 for passage of the propellant gas to the secondary gas channel 182, and ultimately, to within the gas chamber 152, to facilitate operation of the weapons action.

A portion of the outlet end 126 of the gas channel carrier rail 120 has the slot 125, that can have an open "C" shape (FIGS. 4B and 4C), to accommodate insertion of the gas channel carrier guide 180 when inserting the bolt carrier group 140 into the action of the weapon. The slot 125 in the gas channel carrier rail 120 allows the neck of the gas channel carrier guide 180 to pass through when the weapon cycles, moving back and forth during cycling of the weapon.

FIG. 5 depicts a schematic, cross-sectional view of the gas operating system 100 that is pressurized with propellant gas and the bolt carrier group 140 has moved towards the rear of the weapon, according to one or more embodiments described herein. Also, relative to the gas operating system 100 depicted in FIG. 1, the secondary gas channel 182 in the gas channel carrier guide 180 has moved out of alignment with the inlet port 188 in the gas channel carrier rail 120 (thereby preventing propellant gas flow into the secondary gas channel 182 of the gas channel carrier guide 180), as shown in FIG. 5. The bolt head 171 is also unlocked from the barrel extension (not shown). As the carrier assembly 150 and the gas channel carrier guide 180 move rearward, the front gas ring 181 on the gas channel carrier guide 180 keeps the propellant gases contained in the system 100 by moving the inlet port 188 out of fluid communication with the main gas channel 122 and isolated from the expanded segment 132 and/or the extended portion 134.

At this time, the bullet has exited the barrel 101 (FIG. 2) as the carrier assembly 150 continues rearward and the system pressure begins to drop. Additionally, the bolt assembly 170 has moved relatively forward in the carrier assembly 150 and opened the exhaust ports 107 in the right side of the carrier assembly 150 and the propellant gases are discharged through the exhaust ports 107. After the bullet has exited the muzzle and the pressure in the system drops, the exhaust ports 107 open and the pressurized gases are being vented out of the action. The pressurized gases are vented out of the action through the right side of the carrier assembly 150 before the front of the gas channel carrier guide 180 passes the slot 125 in the bottom of the gas channel carrier rail 120 when stroking rearward, thus keeping the gases contained in the system 100. At this point only residual unpressurized gases are present in the system 100, minimizing any gases from entering the other parts of the action. The bolt carrier group 140 is then forced back forward by the operating of buffer spring until the action is closed and the bolt head 171 is locked into the barrel extension and the weapon is ready to be fired again.

Figure 6A:
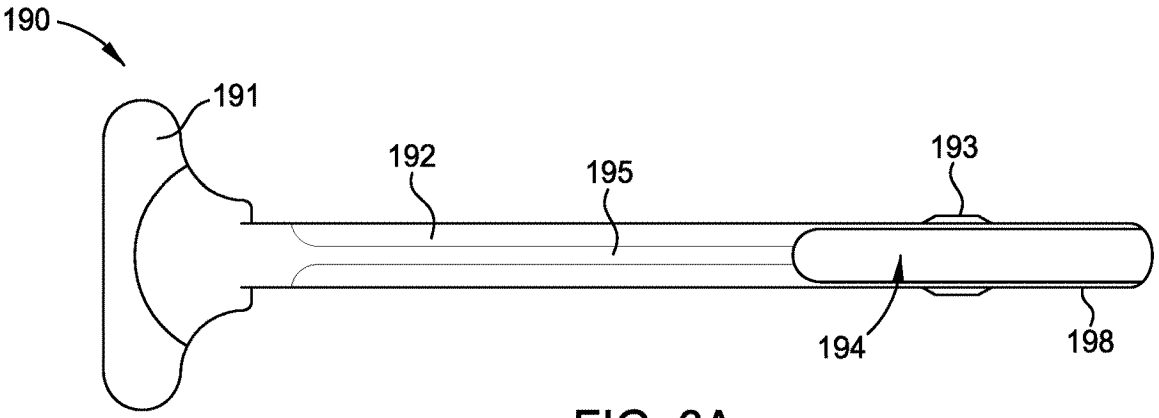
FIGS. 6A-6C depict schematic views of a charging handle, according to one or more embodiments described herein.
Figure 6B:
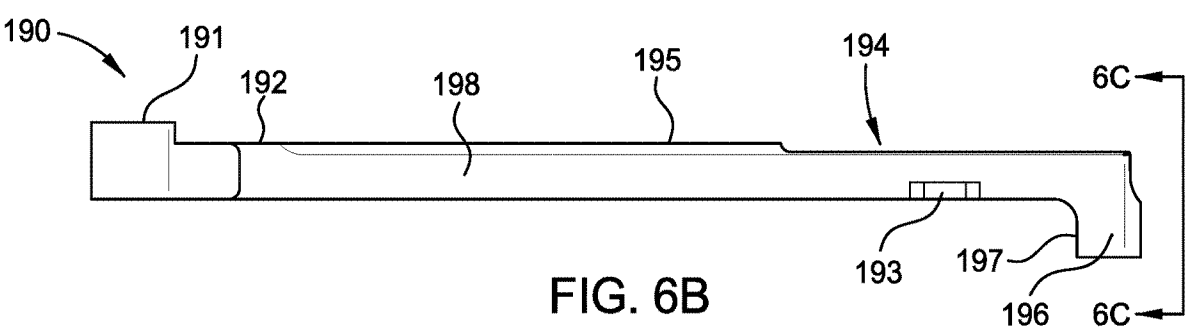
Figure 6C:
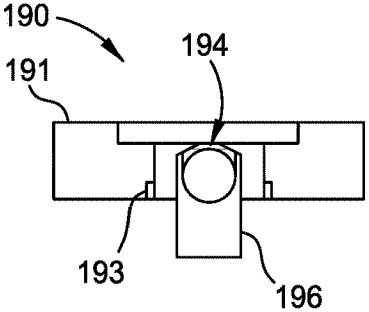

FIGS. 6A-6C depict schematic views of a charging handle 190, according to one or more embodiments described herein. FIG. 6A is a top view, FIG. 6B is a side view, and FIG. 6C is a front view of the charging handle 190. The charging handle 190 includes a handle portion 191 and an elongated lateral member 192. The handle portion 191 can include a locking or latching mechanism (not shown) for latching onto an outside surface of the firearm upper receiver when the charging handle 190 is forwardly inserted into the upper receiver. For example, the charging handle 190 can have a charging handle latch that meet or exceed U.S. military specifications for the M16 or M4 weapon systems. The lateral member 192 of the charging handle 190 has an upper surface 195, alignment tabs 193 protruding from the sides, a slot 194 formed therein, and an engagement portion 196. The alignment tabs 193 are used to align the charging handle 190 when installing the charging handle 190 into the upper receiver. The slot 194 is formed or otherwise defined between the upper surface 195, the sides 198, and the engagement portion 196. The slot 194 accommodates the gas channel carrier rail 120, especially, the outlet end 126 of the gas channel carrier rail 120, when inserting or removing the charging handle 190 during assembling and disassembling the weapon system.

Figure 7:
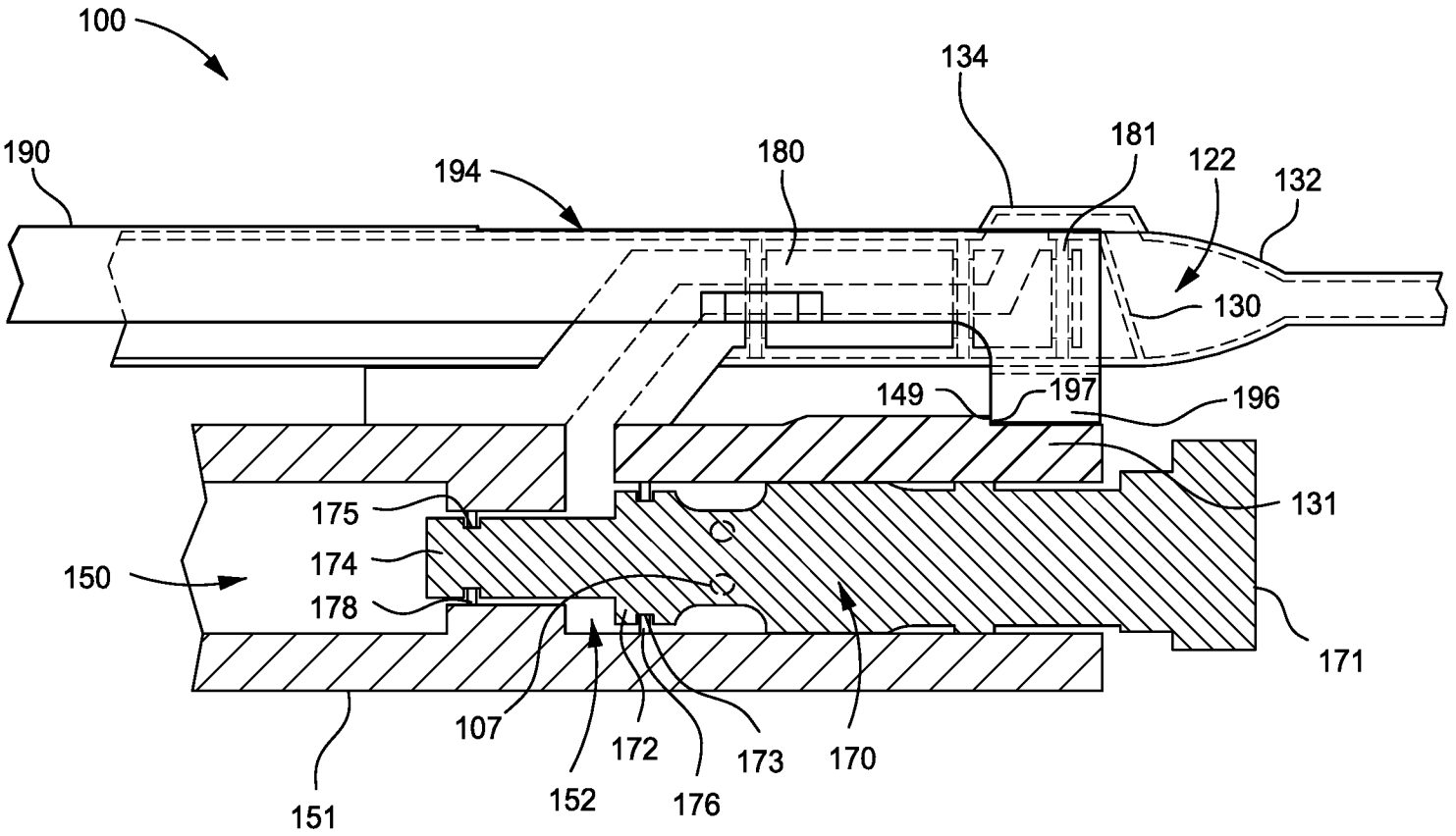
FIG. 7 depicts a schematic, cross-sectional view of the gas operating system shown in FIG. 1 containing a charging handle, according to one or more embodiments described herein.

FIG. 7 depicts a schematic, cross-sectional view of the charging handle 190 disposed in the gas operating system 100, according to one or more embodiments described herein. The charging handle 190 is disposed around at least a portion of the outlet end 126 of the gas channel carrier rail 120. The inner surface 197 of the engagement portion 196 of the charging handle 190 engages or otherwise makes contact to a surface 149 facing a recess formed in the carrier body 151 of the carrier assembly 150. The forward facing surface could also be of a raised feature disposed on the carrier body 151. The contact between the inner surface 197 of the engagement portion 196 and the surface 149 on the carrier body 151 provides the ability to manually cycle the bolt carrier group 140 by pulling back and releasing the charging handle 190.

In one or more embodiments, an upper receiver assembly for one or more weapon systems is provided and can include the upper receiver 104, the barrel 101, and the gas block 103, as depicted in FIGS. 1, 2, and 5, as well as the gas operating system 100, as described and discussed herein. The gas block 103 is fluidly coupled to the barrel 101 and the gas operating system 100 is fluidly coupled to the gas block 103. The gas operating system 100 can be used on any type of automatic and/or semi-automatic weapon systems, including, but not limited to, AR15, M16, M4, AR10, LR308, or any derivative thereof. The gas operating system 100 can be used on a weapon system of any size and/or chambered in any caliber or chambering of rifle and/or handgun ammunition.

Assembly:

The gas channel carrier rail 120 is installed in the upper receiver of the firearm and attached to the gas block at the front of the barrel. The gas channel carrier rail 120 extends from the gas block on the barrel, through the adjustable tensioner 110 and the upper receiver front wall, to just inside the rear of the upper receiver. The charging handle 190 is installed in the same manner as a standard DPI system (e.g., meets military specifications for the M16 or M4 weapon systems) such that the alignment tabs 193 on each side of the charging handle 190 are aligned with the cut outs in the upper receiver and lowered into place. The slot 194 allows the charging handle 190 to pass over the rear portion of the gas channel carrier rail 120 when installed in the upper receiver.

Once the charging handle 190 is installed, the gas channel carrier guide 180 attached to the bolt carrier is inserted into the rear of the gas channel carrier rail 120; the bolt carrier group 140 can then be pushed forward to the closed position. FIG. 7 illustrates a charging handle 190 installed, with the charging handle 190 and the bolt carrier group 140 in the "closed" position. As illustrated, the charging handle 190 accommodates the gas channel carrier guide 180, as well as the gas channel carrier rail 120, when in the closed position, while still allowing functioning of the weapon system.

DGI System Operation:

The gas operating system 100, as described and discussed here, is pressurized via a gas block attached to the barrel. The pressurized propellant gas travels rearward through the gas channel carrier rail 120 and into the gas channel carrier guide 180 through the inlet port 188 in the gas channel carrier rail 120 that are in alignment with the main gas channel 122 on the gas channel carrier guide 180, and into the gas chamber 152 formed in the rear of the bolt carrier group 140. Once pressurized, the action unlocks and, the expanding propellant gases force the carrier assembly 150 to the rear unlocking the bolt head 171 on the bolt assembly 170 from the barrel extension (not shown) allowing the bolt carrier group 140 to move rearward and operate the action of the weapon.

In addition, in contrast to the piston systems described above, the individual parts of the action of the gas operating system 100 are designed to operate with the "balanced in-line" operation of the pressurized gas chamber at the rear of the bolt and carrier. This "balanced in-line" system does not induce any offset or out of alignment forces on the bolt and bolt carrier and allows for a smooth operation of the weapon.

Once the bolt carrier group 140 has moved rearward completely to unlock the bolt from the barrel extension, the front gas rings 176 on the carrier assembly 150 have moved forward of the exhaust ports 107 on the right side of the carrier assembly 150, opening the exhaust ports 107 and allowing the propellant gases to be discharged out through the exhaust ports 107. In such a manner, propellant gas is directed through the exhaust port 107 in the gas operating system 100, rather than permitting exhausted propellant gas from escaping through the rear of the bolt carrier and into the action, as occurs with traditional DGI systems. The bolt carrier group 140 continues rearward until the operating or buffer spring is fully compressed, the compressed buffer spring then forces the bolt carrier group 140 forward and closes the action, with the bolt carrier group 140 locking the bolt head 171 into the barrel extension and the weapon is ready to be fired again.

Benefits of the Direct Gas Impingement (DGI), Gas Operating System 100:

The gas operating system 100 maintains the balanced "in-line" pressurized chamber design that utilizes the expanding gases from the fired cartridge to operate the weapon and contains the gases in a "closed" system that minimizes exposure of the operating parts of the weapon to the hot carbon laden gases that overheat and foul the weapon's action.

The closed system of the gas operating system 100 requires less amount (e.g., volume) of propellant gas to operate than the traditional DGI system because the gas operating system 100 is more efficient, therefore allowing the use of a smaller diameter gas port in the barrel from which the gases are obtained. Because the system requires less volume to operate, less heat and carbon fouling is directed into the system with each shot fired, this results in a cleaner and cooler operating system compared to the traditional DGI system.

The gas operating system 100, as described and discussed herein, is a closed design that keeps the gases that are required to operate the action in a "sealed channel" from the time they enter the system at the gas port in the barrel, until they are discharged out through the right side of the bolt carrier, minimizing exposure of the other components of the weapons action to the propellant gases.

While the foregoing is directed to implementations of the disclosure, other and further implementations may be devised without departing from the basic scope thereof, and the scope thereof is determined by the claims that follow. All documents described herein are incorporated by reference herein, including any priority documents and/or testing procedures to the extent they are not inconsistent with this text. As is apparent from the foregoing general description and the specific embodiments, while forms of the present disclosure have been illustrated and described, various modifications can be made without departing from the spirit and scope of the present disclosure. Accordingly, it is not intended that the present disclosure be limited thereby. Likewise, the term "comprising" is considered synonymous with the term "including" for purposes of United States law. Likewise whenever a composition, an element or a group of elements is preceded with the transitional phrase "comprising", it is understood that we also contemplate the same composition or group of elements with transitional phrases "consisting essentially of," "consisting of", "selected from the group of consisting of," or "is" preceding the recitation of the composition, element, or elements and vice versa.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below.

What is claimed is:

1. A gas operating system for a weapon system comprising an upper receiver and a gas block, the gas operating system comprising:

a gas channel carrier rail comprising a main gas channel disposed between an inlet end an outlet end of the gas channel carrier rail, wherein the outlet end is flared to have a larger diameter than the inlet end, and wherein the gas channel carrier rail is configured to be installed into the upper receiver, extended through a wall of the upper receiver, and attached to the gas block;

a slot formed in the outlet end and extending along the main gas channel; and a bolt carrier group comprising a carrier assembly, a bolt assembly, and a gas channel carrier guide, wherein the bolt assembly is at least partially contained within the carrier assembly, wherein the gas channel carrier guide is disposed on the carrier assembly, and wherein the gas channel carrier guide extends through the slot and is at least partially disposed into the gas channel carrier rail.

2. The gas operating system of claim 1, wherein the gas channel carrier guide comprises a secondary gas channel passing therethrough, and wherein the secondary gas channel is disposed between and in fluid communication with the main gas channel and an interior of the bolt carrier group.

3. The gas operating system of claim 2, wherein the gas channel carrier guide comprises an upper segment and a lower segment, wherein the upper segment extends through the slot and is at least partially disposed into the gas channel carrier rail, and wherein the lower segment is coupled to the carrier assembly.

4. The gas operating system of claim 3, wherein the gas channel carrier guide comprises an inlet port in fluid communication with the main gas channel, and wherein the secondary gas channel extends from the inlet port to the interior of the bolt carrier group.

5. The gas operating system of claim 1, wherein the gas channel carrier guide comprises two or more gas seals disposed on an outer surface of the gas channel carrier guide.

6. The gas operating system of claim 5, wherein the two or more gas seals are disposed between and in contact with the gas channel carrier guide and the gas channel carrier rail.

7. The gas operating system of claim 5, wherein the gas channel carrier guide comprises an inlet port in fluid communication with the main gas channel, and wherein the inlet port is disposed between the two gas seals.

8. The gas operating system of claim 7, wherein the inlet port is disposed on an upper surface of the gas channel carrier guide.

9. The gas operating system of claim 1, wherein the outlet end of the gas channel carrier rail comprises a baffle within the main gas channel.

10. The gas operating system of claim 1, further comprising a gas chamber disposed in the bolt carrier group, wherein the gas chamber is in fluid communication with the main gas channel via a secondary gas channel disposed in the gas channel carrier guide.

11. The gas operating system of claim 10, further comprising the gas chamber is formed between the carrier assembly, the bolt assembly, and two gas seals therebetween.

12. The gas operating system of claim 11, wherein the two gas seals comprise a first gas seal and a second gas seal, the first gas seal is contained on a gas collar disposed on the bolt assembly, and the second gas seal is contained on a bolt tail disposed on the bolt assembly.

13. The gas operating system of claim 1, wherein the carrier assembly further comprises a carrier body, and wherein the gas channel carrier guide and the carrier body are monolithic.

14. The gas operating system of claim 1, wherein the inlet end of the gas channel carrier rail is configured to couple to a gas block disposed on a barrel of the weapon system.

15. The gas operating system of claim 1, further comprising a charging handle disposed around at least a portion of the outlet end of the gas channel carrier rail and makes contact to a surface on the carrier assembly.

16. The gas operating system of claim 1, wherein the gas channel carrier rail extends through an adjustable tensioner that is attached to an upper receiver of the weapon system.

17. The gas operating system of claim 16, wherein the adjustable tensioner is a collet, a grommet, a chuck, or a tensioning collar.

18. A gas operating system for a weapon system comprising an upper receiver and a gas block, the gas operating system comprising:

a gas channel carrier rail comprising a main gas channel disposed between an inlet end an outlet end of the gas channel carrier rail, wherein the outlet end comprises a slot extending along the main gas channel, and wherein the gas channel carrier rail is configured to be installed into the upper receiver, extended through a wall of the upper receiver, and attached to the gas block;

a bolt carrier group comprising a carrier assembly, a bolt assembly, and a gas channel carrier guide, wherein the bolt assembly is at least partially contained within the carrier assembly, wherein the gas channel carrier guide is disposed on the carrier assembly, extends through the slot, and is at least partially disposed into the gas channel carrier rail, and wherein the gas channel carrier guide comprises a secondary gas channel extending therethrough; and a gas chamber disposed in the bolt carrier group, wherein the gas chamber is in fluid communication with the main gas channel via the secondary gas channel, and wherein the gas chamber is formed between the carrier assembly, the bolt assembly, and two gas seals.

19. The gas operating system of claim 18, wherein the two gas seals comprise a first gas seal and a second gas seal, the first gas seal is contained on a gas collar disposed on a bolt body of the bolt assembly, and the second gas seal is contained on a bolt tail disposed on the bolt assembly, wherein the diameter of the bolt tail is smaller than the diameter of the bolt body and the bolt tail is axially aligned with the bolt body.

20. The gas operating system of claim 18, wherein the outlet end of the gas channel carrier rail is flared to have a larger diameter than the inlet end of the gas channel carrier rail.

21. The gas operating system of claim 18, wherein the gas channel carrier guide comprises an upper segment and a lower segment, wherein the upper segment extends through the slot and is at least partially disposed into the gas channel carrier rail, and wherein the lower segment is coupled to the carrier assembly.

22. The gas operating system of claim 21, wherein the gas channel carrier guide comprises an inlet port in fluid communication with the main gas channel, and wherein the secondary gas channel extends from the inlet port to the interior of the bolt carrier group.

23. An upper receiver assembly for a weapon system, comprising:

an upper receiver comprising a barrel;

a gas block fluidly coupled to the barrel;

a gas operating system fluidly coupled to the gas block, wherein the gas operating system comprises:

a gas channel carrier rail comprising a main gas channel disposed between an inlet end an outlet end of the gas channel carrier rail, wherein the outlet end comprises a slot extending along the main gas channel, and wherein the gas channel carrier rail is disposed in the upper receiver, extended through a wall of the upper receiver, and attached to the gas block;

a bolt carrier group comprising a carrier assembly, a bolt assembly, and a gas channel carrier guide, wherein the bolt assembly is at least partially contained within the carrier assembly, wherein the gas channel carrier guide is disposed on the carrier assembly, extends through the slot, and is at least partially disposed into the gas channel carrier rail, and wherein the gas channel carrier guide comprises a secondary gas channel extending therethrough; and a gas chamber disposed in the bolt carrier group, wherein the gas chamber is in fluid communication with the main gas channel via the secondary gas channel, and wherein the gas chamber is formed between the carrier assembly, the bolt assembly, and two gas seals.

24. The upper receiver assembly of claim 23, wherein the gas channel carrier rail is a monolithic piece.

25. The gas operating system of claim 1, wherein the gas channel carrier rail is a monolithic piece.

26. The gas operating system of claim 18, wherein the gas channel carrier rail is a monolithic piece.

* * * * *